US008783817B2

(12) United States Patent
Higashitani

(10) Patent No.: US 8,783,817 B2
(45) Date of Patent: Jul. 22, 2014

(54) RECORDING DEVICE AND RECORDING METHOD

(75) Inventor: Kosuke Higashitani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 269 days.

(21) Appl. No.: 13/035,838

(22) Filed: Feb. 25, 2011

(65) Prior Publication Data

US 2011/0210498 A1 Sep. 1, 2011

(30) Foreign Application Priority Data

Feb. 26, 2010 (JP) ..... 2010-043422

(51) Int. Cl.
*B41J 29/393* (2006.01)

(52) U.S. Cl.
USPC ..... 347/19; 347/16; 347/104

(58) Field of Classification Search
USPC ..... 347/9, 14, 16, 19, 104, 5
See application file for complete search history.

(56) References Cited

U.S. PATENT DOCUMENTS

| | | | | |
|---|---|---|---|---|
| 7,533,959 | B2 | 5/2009 | Ouchi et al. | |
| 7,537,302 | B2 * | 5/2009 | Endo | 347/19 |
| 2006/0170720 | A1 | 8/2006 | Akase et al. | |
| 2006/0221108 | A1 | 10/2006 | Morisaki | |
| 2006/0221111 | A1 | 10/2006 | Ouchi et al. | |
| 2007/0076081 | A1 * | 4/2007 | Yoshida | 347/104 |
| 2007/0201922 | A1 | 8/2007 | Takahashi | |
| 2007/0291063 | A1 | 12/2007 | Akase et al. | |
| 2010/0277535 | A1 | 11/2010 | Akase et al. | |

FOREIGN PATENT DOCUMENTS

| | | | |
|---|---|---|---|
| JP | 62-198482 | A | 9/1987 |
| JP | 4-361076 | A | 12/1992 |
| JP | 5-221070 | A | 8/1993 |
| JP | 08-002706 | A | 1/1996 |
| JP | 2001-179954 | A | 7/2001 |
| JP | 2006-272695 | A | 10/2006 |
| JP | 2006-273507 | A | 10/2006 |
| JP | 2006-321593 | A | 11/2006 |
| JP | 2007-226044 | A | 9/2007 |
| JP | 2010-023517 | A | 2/2010 |

* cited by examiner

*Primary Examiner* — Lam S Nguyen
(74) *Attorney, Agent, or Firm* — Kilpatrick Townsend & Stockton LLP

(57) ABSTRACT

A recording device which carries out the recording process with respect to a recording medium using a recording unit mounted on a moving member that reciprocates along a scan direction intersecting a feeding direction of the recording medium, including a reception unit that receives a recording instruction; an end portion detection unit that detects a position of an end portion in the width direction of the recording medium, based on a detection signal that is output from a signal output portion provided in the moving member; a memory unit that stores end portion positional information; and a control unit that controls the movement of the moving member so that, when the end portion positional information is stored in the memory unit and an edge recording is instructed by the recording instruction, the position of the end portion in the width direction of the recording medium is not detected.

8 Claims, 10 Drawing Sheets

RECORDING DEVICE AND RECORDING METHOD

This application claims priority to Japanese Patent Application No. 2010-043422, filed Feb. 26, 2010, the entirety of which is incorporated by reference herein.

BACKGROUND

1. Technical Field

The present invention relates to a recording device and a recording method.

2. Related Art

Generally, as a recording device which performs a recording process on a recording medium, a recording device is known which performs the recording process while moving a recording head as a recording unit in a predetermined scan direction. In such a recording device, there are provided a carriage (moving member) on which the recording head is mounted and which is moved along a main scan direction, and a feeding device, which feeds the recording medium along a sub scan direction (feeding direction) intersecting the main scan direction.

Furthermore, the recording device has a function of detecting an end portion of the recording medium so as to print (recording process) an image with respect to the recording medium at a desired position. Specifically, in the recording device, there are provided a front end detection sensor that is provided in the feeding path of the recording medium and detects the front end of the recording medium during feeding, and a transverse end detection sensor that is provided in the carriage and detects the end portion in the width direction of the recording medium during printing.

Moreover, at the time of the printing to the recording medium, a control device of the recording device detects the front end of the recording medium, which is fed by the feeding device, by the detection signal from the front end detection sensor, and specifies a printing start position in the recording medium based on the detection result. Next, when the front end of the recording medium is fed up to a position immediately below the carriage, the control device detects the end portion in the width direction of the recording medium based on the detection signal from the transverse end detection sensor by moving the carriage in the main scan direction, and accurately detects the position of the recording medium in the printing region. As a consequence, it is possible to print an image at a desired position of the recording medium (see JP-A-2006-273507).

However, in the recording device described in JP-A-2006-273507, during printing to one recording medium, after the detection of the end portion in the width direction of the recording medium is finally performed, and when the recording medium is fed by a preset and predetermined distance, the detection of the end portion in the width direction of the recording medium is performed again. In order to perform the detection of the end portion in the width direction of the recording medium, naturally, even though there is no need to move the carriage up to the end portion in the width direction of the recording medium, the carriage needs to be moved up to end portion in the width direction of the recording medium. For that reason, there is a problem in that the printing speed relative to the recording medium declines due to excess movement of the carriage during printing.

SUMMARY

An advantage of some aspects of the invention is to provide a recording device and a recording method that can improve the recording speed relative to the recording medium.

According to an aspect of the invention, there is provided a recording device which carries out the recording process with respect to a recording medium using a recording unit mounted on a moving member which reciprocates along a scan direction intersecting a feeding direction of the recording medium, including a reception unit that receives a recording instruction; an end portion detection unit that detects a position of the end portion in the width direction of the recording medium, based on a detection signal which is output from a signal output portion provided in the moving member; a memory unit that stores end portion positional information on the position detected by the end portion detection unit; and a control unit that controls the movement of the moving member so that, in a case where the end portion positional information is stored in the memory unit, the size of the recording medium when the end portion positional information is stored is identical to the size of the recording medium instructed by the recording instruction, and when an edge recording is instructed by the recording instruction, the position of the end portion in the width direction of the recording medium is not detected.

According to the configuration, in a case where the end portion positional information is stored in the memory unit, when the edge recording is carried out with respect to the recording medium having the same size as that of the recording medium when the end portion positional information is stored, the position of the end portion in the width direction of the recording medium is not detected. For that reason, as compared to a case where the moving member is moved to the end portion side in the width direction of the recording medium so as to detect the position of the end portion in the width direction of the recording medium, it is possible to reduce the movement amount of the moving member at the time of the recording process to one recording medium. Thus, it is possible to improve the recording speed relative to the recording medium through the reduction of the movement amount of the moving member.

In the recording device according to an aspect of the invention, in a case where the end portion positional information is stored in the memory unit, when an edge/non-edge recording is instructed with respect to the next recording medium by the recording instruction, the control unit allows the movement of the moving member to the end portion side in the width direction of the next recording medium for detecting the position of the end portion in the width direction of the next recording medium, and the end portion detection unit detects the position of the end portion in the width direction of the next recording medium based on the detection signal that is output from the signal output portion when the moving member is moved to the end portion side in the width direction of the recording medium.

According to the configuration, in a case where the non-edge recording is carried out with respect to the recording medium by the instruction from the recording instruction, even in the recording process relative to the recording medium having the same size as that of the recording medium when the end portion positional information is stored, the moving member is moved to the end portion side in the width direction of the recording medium so as to detect the position of the end portion in the width direction of the recording medium, and the position of the end portion in the width direction of the recording medium is detected. For that reason, it is possible to maintain the recording accuracy of the recording medium at the time of the non-edge recording.

In the recording device according to an aspect of the invention, a feeding device is further included which can feed the recording media of a plurality of sizes having different lengths in the width direction and has a feeding roller coming into contact with a part in the width direction of the recording medium. The feeding roller is disposed in a position where a first distance between the feeding roller and an end in the width direction of a recording medium of a first size is different from a first distance between the feeding roller and an end in the width direction of a recording medium of a second size different from the first size, and a second distance between the feeding roller and the other end in the width direction of the recording medium of the first size is different from a second distance between the feeding roller and the other end in the width direction of the recording medium of the second size.

According to the configuration, the feeding roller is correspondingly disposed at a position different from the end portion in the width direction of the recording medium. For that reason, as compared to the case where the feeding roller is disposed at a position corresponding to the end portion in the width direction of the recording medium, it is possible to suppress the recording medium to be fed from obliquely sloping with respect to the feeding direction. Thus, it is possible to suppress a decline in recording accuracy relative to the recording medium using the end portion positional information stored in the memory unit, even in a case where the recording process is carried out in the recording medium.

The recording device according to an aspect of the invention further includes an accommodation device that can be freely attached to and detached from the recording device and accommodates the recording medium before the recording process, and an attachment and detachment detection unit that detects the detachment of the accommodation device from the recording device. After the detachment of the accommodation device from the recording device is detected by the attachment and detachment detection unit, the accommodation device is mounted on the recording device, and then, when the recording process is performed, the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium, and stores the end portion positional information on the position in the memory unit.

In a case where the accommodation device is attached from the recording device, there is a possibility that the accommodation device is mounted on the recording device again in a state in which a recording medium of a size different from the size before being detached is accommodated. Thus, in the aspect of the invention, in a case where the detached accommodation device is mounted on the recording device again, at the time of the initial recording process based on the received recording instruction, the moving member is moved to the end portion side in the width direction of the recording medium so as to detect the position of the end portion in the width direction of the recording medium, and the position of the end portion in the width direction of the recording medium is detected. Moreover, the end portion positional information on the position of the end portion in the width direction of the detected recording medium is stored in the memory unit. For that reason, at the present time, it is possible to store the suitable end portion positional information depending on the size of the recording medium, which is accommodated in the accommodation device, in the memory unit.

In the recording device according to an aspect of the invention, in a case where the recording process to a plurality of recording media of the same sizes is performed by one recording instruction, at the time of the recording process to a first recording medium, the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium, and stores the end portion positional information on the position in the memory unit. When the edge recording is carried out in the recording medium after the second, the control unit does not allow the movement of the moving member to the end portion side in the width direction of the recording medium for detecting the position of the end portion in the width direction of the recording medium.

According to the configuration, in a case where the recording process is carried out with respect to a plurality of recording media by the recording instruction, at the time of the recording process to the first recording medium, the moving member is moved to the end portion side in the width direction of the recording medium in order to detect the position of the end portion in the width direction of the recording medium, and the position of the end portion in the width direction of the recording medium is detected. Moreover, the end portion positional information on the position of the end portion in the width direction of the detected recording medium is stored in the memory unit. Next, at the time of the recording process to the recording medium after the second, the moving member is not allowed to move to the end portion side in the width direction of the recording medium in order to detect the position of the end portion in the width direction of the recording medium. That is, in the recording medium after the second, the recording process is carried out based on the end portion positional information stored in the memory unit. Thus, the recording processing speed can be improved.

In the recording device according to an aspect of the invention, in a case where the recording process is performed by the recording instruction, the end portion positional information is stored in the memory unit, the size of the recording medium when the end portion positional information is stored in the memory unit is identical to the size of the recording medium instructed by the recording instruction, and when the edge recording is instructed by the recording instruction, the control unit does not allow the movement of the moving member to the end portion side in the width direction of the recording medium for detecting the position of the end portion in the width direction of the recording medium.

According to the configuration, in a case where the recording process is carried out with respect to the same size as that of the recording medium when the end portion positional information is stored in the memory unit, it is restricted that the moving member is moved to the end portion side in the width direction of the recording medium in order to detect the end portion positional information. Thus, the recording process speed can be improved.

The recording device according to an aspect of the invention further includes a feed abnormality determination unit which determines whether or not the feed abnormality of the recording medium occurs based on the end portion positional information detected at the time of the recording process to one recording medium. In a case where it is determined that the feed abnormality occurs by the feeding abnormality determination unit, when the recording process to the next recording medium is performed, the control unit allows the movement of the moving member to the end portion side in the width direction of the next recording medium for detecting the position of the end portion in the width direction of the next recording medium, and the end portion detection unit detects the position of the end portion in the width direction of the next recording medium based on the detection signal from the signal output portion when the moving member is moved to the end portion side in the width direction of the next recording medium.

According to the configuration, in a case where it is determined that the feed abnormality occurs, at the time of the recording process to the recording medium, the moving member is moved to the end portion side in the width direction of the recording medium in order to detect the end portion positional information all the time, and the position of the end portion in the width direction of the recording medium is detected. Thus, it is possible to suppress the decline in recording accuracy based on the occurrence of feed abnormality.

According to another aspect of the invention, there is provided a recording method of carrying out the recording process with respect to a recording medium using a recording unit mounted on a moving member which reciprocates along the scan direction intersecting the feeding direction of the recording medium, including the steps of: receiving a recording instruction; detecting the position of an end portion in the width direction of the recording medium based on a detection signal to be output from a signal output portion provided in the moving member and storing end portion positional information on the position in a memory unit; and controlling the movement of the moving member so that, in a case where the end portion positional information is stored in the memory unit, the size of the recording medium when the end portion positional information is stored is identical to the size of the recording medium instructed by the recording instruction, and when the recording instruction instructs an edge recording, the end portion positional information is not detected.

According to the configuration, it is possible to obtain the same effect as the recording device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment embodying the invention will be described based on FIGS. 1 to 10. In addition, in the following description in the description, "a back and forth direction", "a left and right direction", and "an up and down direction" show the back and forth direction (a sub scan direction), the left and right direction (a main scan direction), and the up and down direction shown in FIG. 1 by arrows, respectively.

Figure 1:
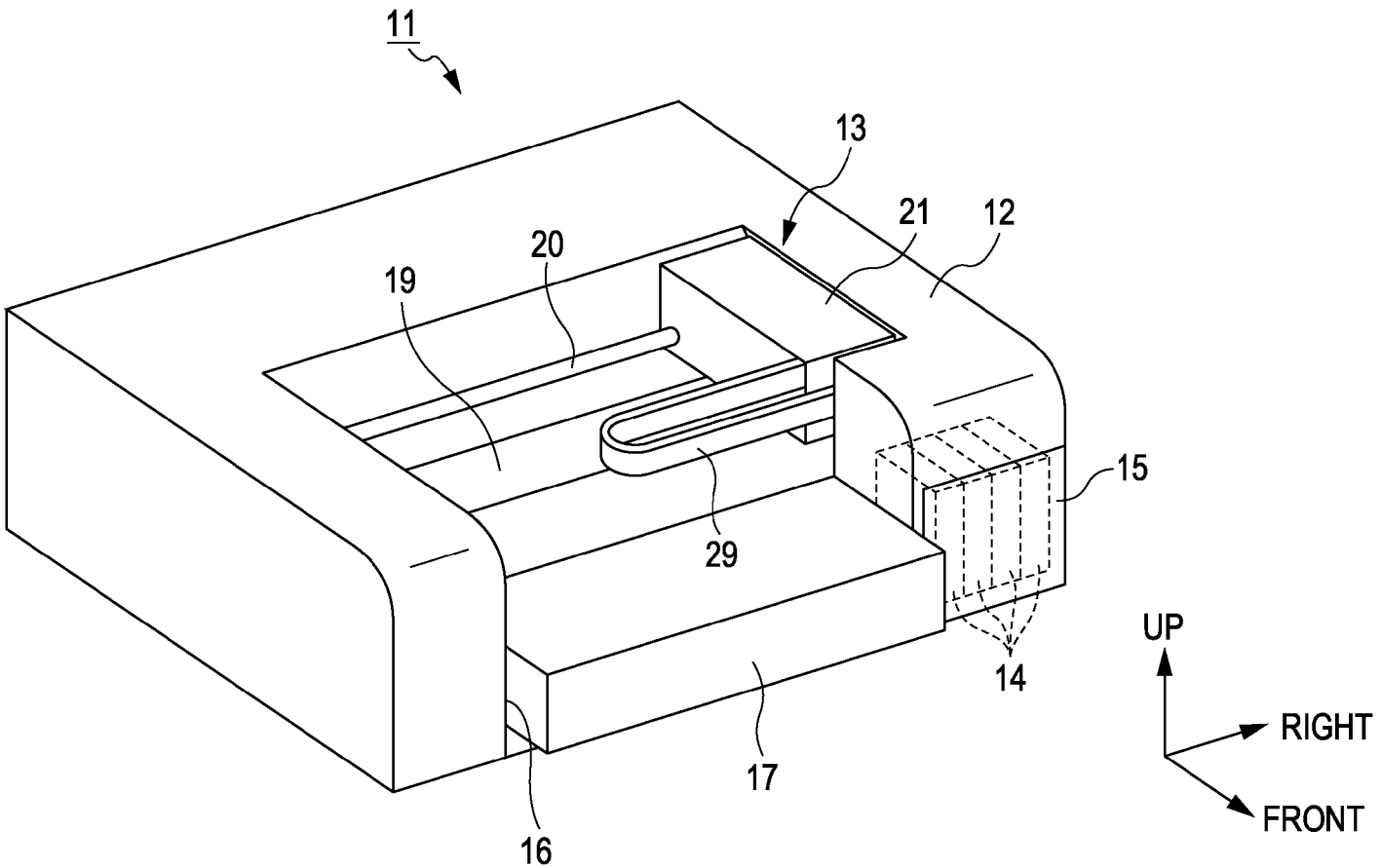
FIG. 1 is a perspective view of a printer in a first embodiment.

As shown in FIG. 1, a printer 11 as a recording device is an ink jet type of printer and includes a main body case 12 having an approximately square box shape that covers the whole device. In the main body case 12, there are provided a printing portion 13 which carries out the printing process (the recording process) of a paper P (see FIG. 2) as the recording medium, and a holder portion 15 which is situated at the right side of the printing portion 13 and on which a plurality (in the present embodiment, four) of ink cartridges 14 is mounted in the state of being freely attached and detached. Furthermore, in a receiving concave portion 16 which is situated in a lower part of the printing portion 13 and has an open front, a paper feeding cassette 17 as an accommodation device, in which a plurality of papers P before the printing process is accommodated, is mounted in the state of being freely inserted and extracted (freely attached and detached). Moreover, in the paper feeding cassette 17, the paper P is fed (transported) into the printing portion 13 by a feeding device 50 (see FIG. 5).

Next, the printing portion 13 will be described.

Figure 2:
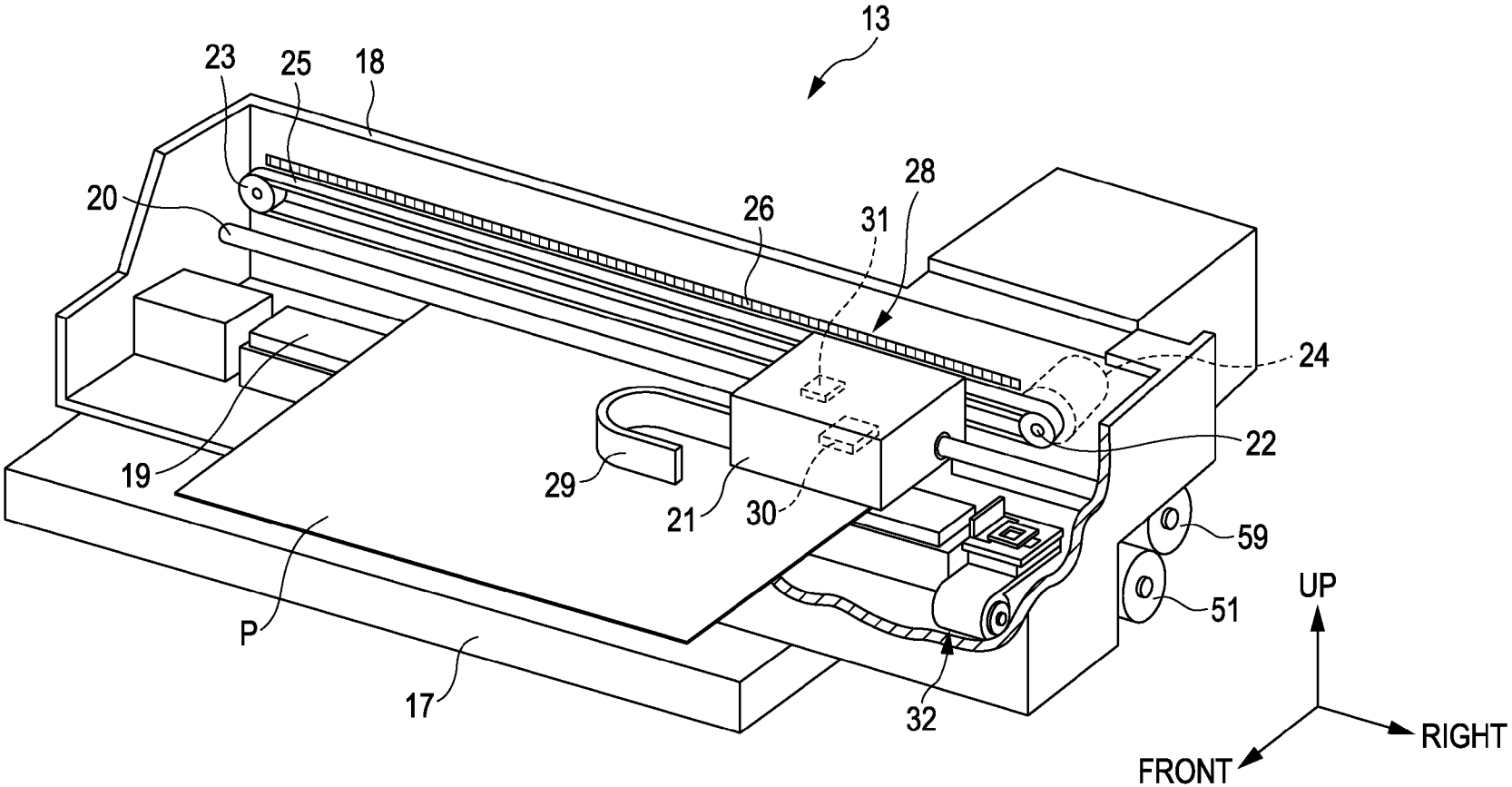
FIG. 2 is a perspective view of a printer of a state in which a main body case is detached.

As shown in FIG. 2, the printing portion 13 includes an approximately rectangular box-shaped frame 18 in which the paper P is fed from the inside of the paper feeding cassette 17 from a rear side toward a front by the driving of the feeding device 50. In a lower part of the frame 18, a platen 19, which supports the paper P fed into the frame 18, is provided so as to extend along the left and right direction. Furthermore, at an upper part of the platen 19 in the frame 18, a rod-shaped guide shaft 20 parallel to a longitudinal direction (the left and right direction) of the platen 19 is provided. In the guide shaft 20, a carriage 21 as a moving member is supported in a state that can reciprocate along the axial direction (the left and right direction, and the main scan direction) thereof.

At each position corresponding to both end portions of the guide shaft 20 in a rear wall inner surface of the frame 18, a driving pulley 22 and a driven pulley 23 are supported in a rotatable state. An output shaft of a carriage motor (hereinafter, also referred to as "CR motor") 24 becoming a driving source at the time of reciprocating the carriage 21 is connected to the driving pulley 22, and an endless timing belt 25 spans between a pair of pulleys 22 and 23, and a part of the timing belt 25 is connected to the carriage 21. Thus, the carriage 21 is moved in the left and right direction via the endless timing belt 25 by the driving force of the CR motor 24, while being guided to the guide shaft 20.

Figure 6:
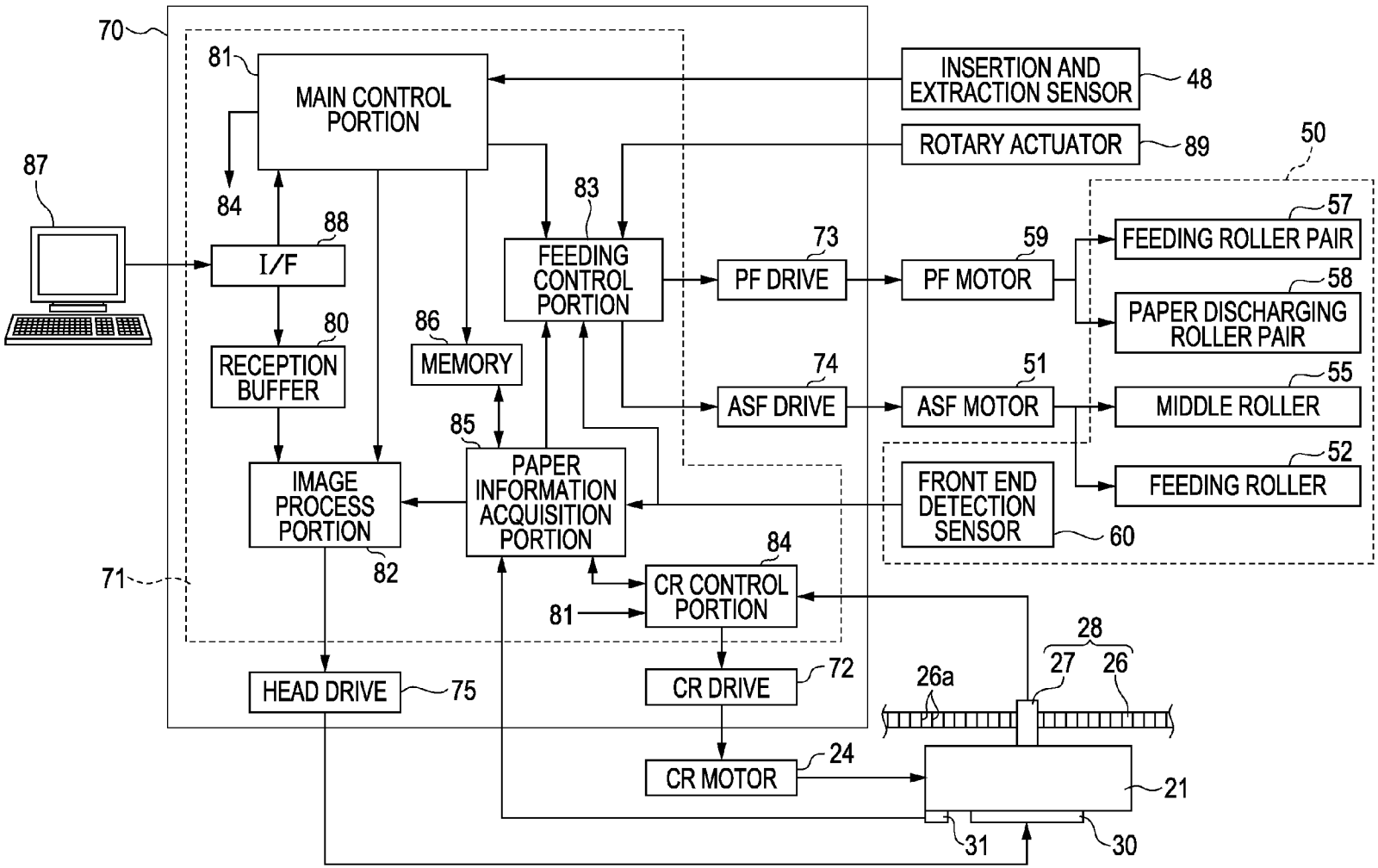
FIG. 6 is a block diagram that explains principal parts of an electric configuration of a printer.

Furthermore, in the frame 18, as shown in FIGS. 2 and 6, a linear encoder 28 is provided which includes a detection target tape 26 disposed in a rear wall inner surface and extending in the left and right direction, and a detection portion 27 provided in the carriage 21. In the detection target tape 26, a plurality of slits 26*a* is formed along the left and right direction at equal distances, and a plurality of (as an example, two) sensors (not shown) disposed at positions different from each other in the left and right direction is provided in the detection portion 27. Moreover, in the respective sensors of the detection portion 27, pulse-shaped detection signals equivalent to the movement distance of the carriage 21 are output to a control device 70 (see FIG. 6) described later, respectively.

The respective ink cartridges 14 mounted on the holder portion 15 are connected to the carriage 21 via ink supply tubes (not shown) of a plurality of lines (for example, four) placed in a flexible wiring board 29 (not shown). On a lower surface side facing the platen 19 in the carriage 21, as shown in FIG. 2, a recording head 30 as a recording unit is mounted to which ink is supplied from the respective ink cartridges 14 via the flexible wiring board 29 or the like. Moreover, ink droplets are discharged from a plurality of nozzles (not shown), which opens to the lower surface (also referred to as "a nozzle forming surface") of the recording head 30, to the paper P fed onto the platen 19, whereby the printing is performed.

Figure 3:
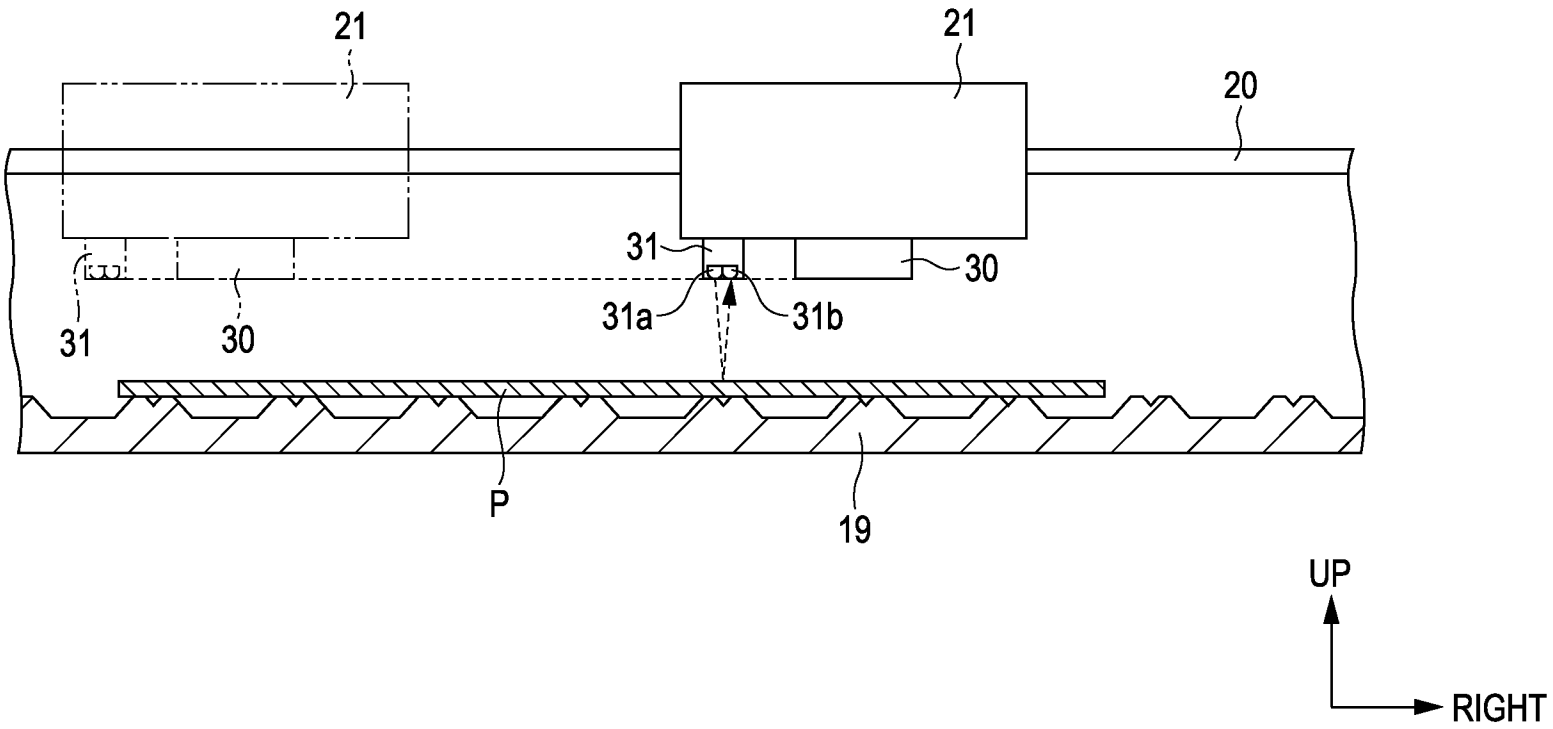
FIG. 3 is a cross-sectional view that schematically shows appearance state of the movement of a carriage.

Furthermore, at the lower surface side of the carriage 21 and the left side of the recording head 30, as shown in FIGS. 2 and 3, an optical end portion detection sensor (a signal output portion) 31 having a light emitting portion 31*a* and a light sensing portion 31*b* is provided. In the end portion detection sensor 31, a detection light is output from the light emitting portion 31*a* toward the platen 19 side (that is, a lower part), and the light sensing portion 31*b* senses the reflective light from the platen 19 or the paper P supported by the platen 19. Moreover, a detection signal depending on the light sensing amount in the light sensing portion 31*b* is output from the end detection sensor 31 to a control device 70 described later.

Furthermore, at the right side of a printing region where the paper P is fed in the frame 18, a home position region, where the paper P is not fed, is formed. In the home position region, a maintenance device 32 for performing various maintenances such as the cleaning of the recording head 30 is provided.

Next, the paper feeding cassette 17 will be described.

Figure 4:
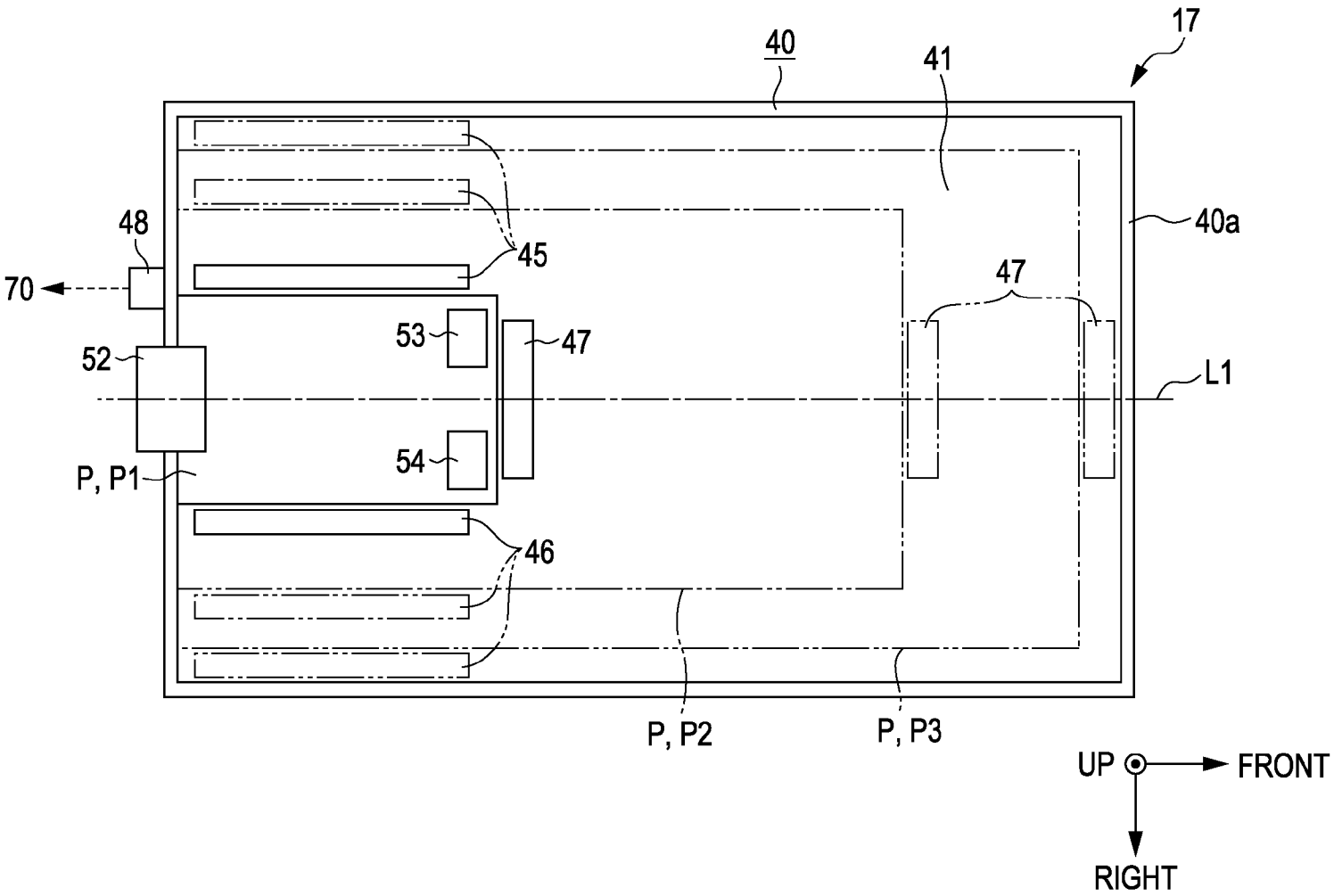
FIG. 4 is a plan view that schematically shows a paper feeding cassette.
Figure 5:
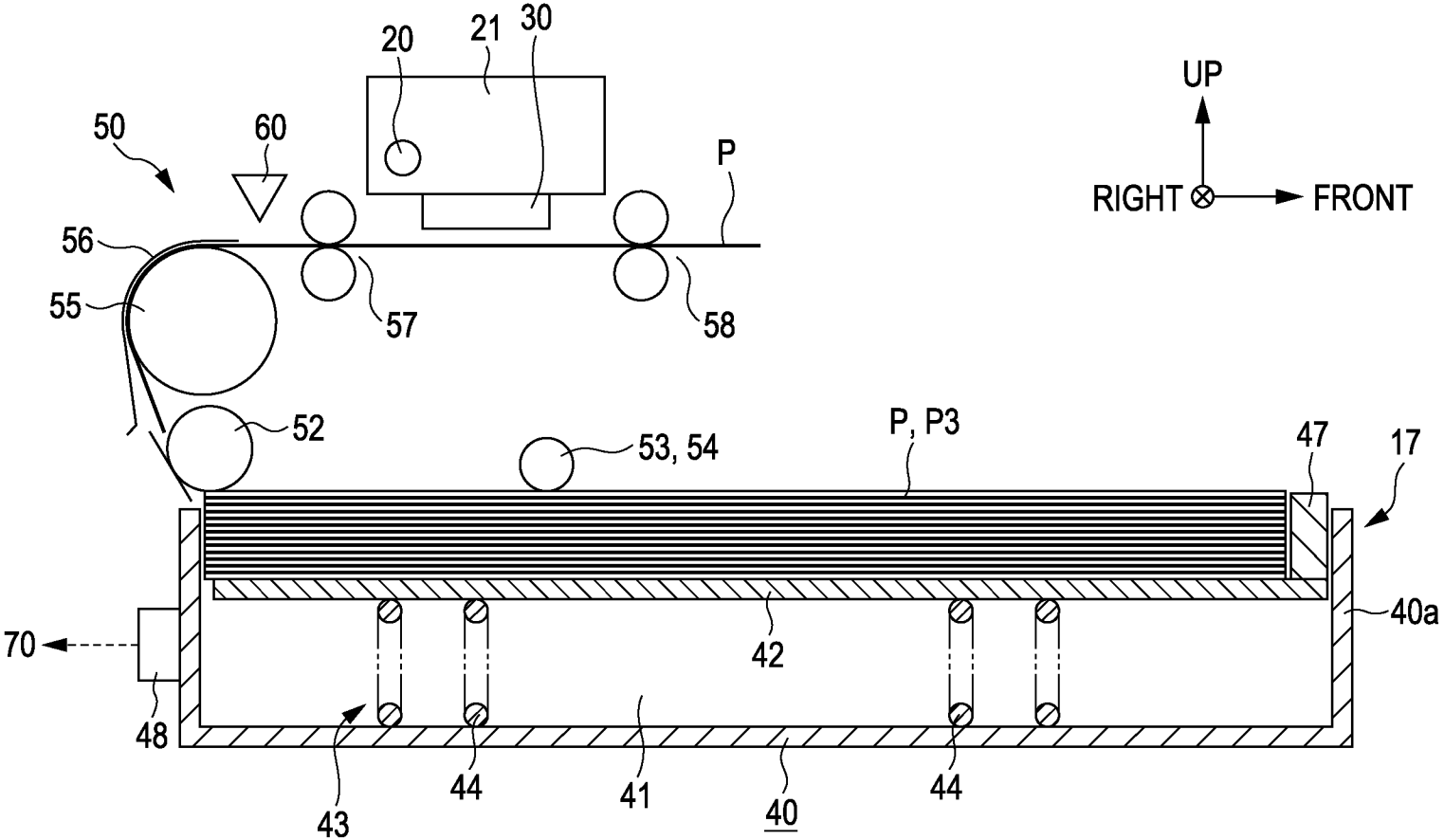
FIG. 5 is a cross-sectional view that schematically shows a paper feeding cassette and a feeding device.

As shown in FIGS. 4 and 5, the paper feeding cassette 17 includes an approximately square box-shaped cassette main body 40 having an open upper part. In the cassette main body 40, an accommodation chamber 41 is formed in which the papers P are accommodated in a stacked state. In the accommodation chamber 41, an approximately rectangular plate-shaped installation platform 42 on which the paper P is installed, and a lifting mechanism 43 for lifting up and down the installation platform 42 along the up and down direction are provided. The lifting mechanism 43 has a biasing member 44 (as an example, a coil spring) that is disposed between the lower wall of the cassette main body 40 and the installation platform 42 and biases the installation platform 42 upward.

The paper feeding cassette 17 of the present embodiment is configured so that it can accommodate the papers P of various sizes. That is, on the installation platform 42, a pair of side portion guides 45 and 46 disposed at both left and right sides of the paper P is provided. The both side portion guides 45 and 46 are disposed at a position which is the line symmetry around a center line L1 (shown in FIG. 4 by an alternate long and short dash line) that is situated at a center in the left and right direction of the cassette main body 40 and extends along the back and forth direction. Furthermore, both side portion guides 45 and 46 can be interlocked with each other along the left and right direction and can approach and can be separated from each other. As a consequence, the centers of the left and right direction of the papers P (P1, P2 and P3) accommodated in the accommodation chamber 41 approximately coincide with the center of the left and eight direction of the cassette main body 40 regardless of the size of the paper P.

Furthermore, at a front side of the paper P on the installation platform 42, there is provided a front portion guide 47 for making a gap between the rear end of the paper P accommodated in the accommodation chamber 41 and a rear side wall portion 40*a* of the cassette main body 40 less than a predetermined gap. The front portion guide 47 can move in the back and forth direction depending on the size of the paper P to be accommodated in the accommodation chamber 41.

Meanwhile, in the receiving concave portion 16, an insertion and extraction sensor 48 for detecting the mounting of the paper feeding cassette 17 in the receiving concave portion 16 is provided. In the insertion and extraction sensor 48, when the paper feeding cassette 17 is mounted in the receiving concave portion 16, an on signal is output to a control device 70 described later, on the other hand, when the paper feeding cassette 17 is not mounted in the receiving concave portion 16, an off signal is output to the control device 70.

In addition, in the present embodiment, the paper P1 is a paper of A5 size, the paper P2 is a paper of A4 size, and the paper P3 is a paper of A3 size. That is, among the respective papers P1, P2 and P3, the paper P3 is the largest, and the paper P1 is the smallest.

Next, the feeding device 50 will be described.

As shown in FIGS. 4 and 5, the feeding device 50 includes a feeding roller 52 that is disposed in the center in the left and right direction at a rear end side of the paper feeding cassette 17 and is rotated based on the driving of an ASF motor 51 (see FIG. 6). That is, a first distance between the feeding roller 52 and the left end of the paper P1 (P2 and P3) is approximately equal to a second distance between the feeding roller 52 and the right end of the paper P1 (P2 and P3). Furthermore, a first distance between the feeding roller 52 and the left end of the paper P1 of the first size is shorter than a first distance between the feeding roller 52 and the left end of the paper P2 of the second size, and a first distance between the feeding roller 52 and the left end of the paper P2 is shorter than a first distance between the feeding roller 52 and the left end of the paper P3 of the third size. Similarly, a second distance between the feeding roller 52 and the right end of the paper P1 is shorter than a second distance between the feeding roller 52 and the right end of the paper P2, and a second distance between the feeding roller 52 and the right end of the paper P2 is shorter than a second distance between the feeding roller 52 and the right end of the paper P3.

At a front side further than the feeding roller 52, a pair of driven rollers 53 and 54 disposed at a position becoming the line symmetry around the center line L1 are provided. The outer peripheral surfaces of the respective rollers 52 to 54 are pressure-welded to the uppermost paper P among the respective papers P accommodated in the paper feeding cassette 17, and the respective rollers 52 to 54 are rotated around an axis (not shown) extending along the left and right direction, respectively.

As shown in FIGS. 4 and 5, at an upper part of the feeding roller 52, a middle roller 55 is provided which has a diameter larger than that of the feeding roller 52 and is rotated based on the driving of the ASF motor 51. The middle roller 55 is rotated around an axis (not shown) extending along the left and right direction. Moreover, an approximately circular arcshaped arc guide 56 disposed at a position separated from the outer peripheral surface of the middle roller 55 by a predetermined gap is provided near the middle roller 55.

Furthermore, at a rear side of the platen 19 in the front side of the middle roller 55, a paper feeding roller pair 57 having a driving roller and a driven roller is provided, and at the front side of the platen 19, a paper discharging roller pair 58 having a driving roller and a driven roller is provided. The respective driving rollers are rotated based on the driving of a PF motor 59 (see FIG. 6), respectively. In addition, between the middle roller 55 and the paper feeding roller pair 57 in the back and forth direction, a front end detection sensor 60 for detecting the fore end (a front end) of the paper P to be fed is provided.

Moreover, when the feeding roller 52 and the middle roller 55 are rotated, the uppermost paper P in the paper feeding cassette 17 is fed from the paper feeding cassette 17 upwards. Then, the feeding direction of the paper P is changed from the upward to the front by the middle roller 55 and the arc guide 56. As a consequence, the paper P is fed from the middle roller 55 side toward the front. At this time, when the front end in the feeding direction (sub scan direction) of the paper P is detected by the front end detection sensor 60, the front end detection sensor 60 outputs the detection signal (hereinafter, also referred to as "front end detection signal") to the effect that the front end is detected to the control device 70.

After that, when the front end in the feeding direction of the paper P is pinched by the respective rollers constituting the paper feeding roller pair 57, the paper P is fed onto the platen 19 by the paper feeding roller pair 57. In addition, when the front end in the feeding direction of the paper P is pinched by the respective rollers constituting the paper discharging roller pair 58, the paper P is discharged to the outside of the frame 18.

Next, principal parts of an electric configuration of the printer 11 of the present embodiment will be described.

As shown in FIG. 6, the control device 70 of the printer 11 includes a digital computer 71 (a portion surrounded by dotted lines in FIG. 6) which is constructed by a CPU, a ROM, a RAM, a nonvolatile memory, an ASIC (Application Specific IC (specific application dedicated IC)) or the like (not shown). The digital computer 71 is electrically connected to a CR driver 72 for driving a CR motor 24, a PF driver 73 for driving a PF motor 59, an ASF driver 74 for driving an ASF motor 51, and a head driver 75 for driving a recording head 30.

Furthermore, the digital computer 71 includes a reception buffer 80, a main control portion 81, an image processing portion 82, a feeding control portion 83, a CR control portion 84, a paper information acquisition portion 85, and a memory 86, as function portions realized by at least one of hardware and software. In addition, the memory 86 includes a RAM.

The reception buffer 80 temporarily keeps image information and a printing instruction (recording instruction) received from a host computer 87 via an interface 88. In the printing instruction, information on the size of the paper P carrying out the printing, information on non-edged printing (non-edged recording) or an edge printing (edge recording) or the like are included. Thus, in the present embodiment, the reception buffer 80 functions as a reception unit.

The main control portion 81 suitably outputs the control command to the image processing portion 82, the feeding control portion 83, the CR control portion 84 and the paper information acquisition portion 85. Specifically, when the printing command is received from the host computer 87 side via the interface 88, the main control portion 81 outputs the control command of the purpose of creating a raster data based on the image information received by the reception buffer 80 to the image processing portion 82. Furthermore, the main control portion 81 outputs the control command of the purpose of starting the paper feeding of the paper P to the feeding control portion 83, and outputs the control command of the purpose of starting the movement of the carriage 21 to the CR control portion 84. Furthermore, the main control portion 81 manages a state of the paper feeding cassette 17 based on the detection signal from the insertion and extraction sensor 48. That is, when the detection signal from the insertion and extraction sensor 48 is changed from the on signal to the off signal, the main control portion 81 detects that the paper feeding cassette 17 is detached from the printer 11. Thus, in the present embodiment, an attachment and detachment detection unit is constituted by the insertion and extraction sensor 48 and the main control portion 81.

The image processing portion 82 carries out various conversion processes (resolution conversion process, color conversion process, halftone process or the like) in the image information kept in the reception buffer 80 to create the raster data. Moreover, at the time of the printing based on the image information or the like, the image processing portion 82 outputs the driving signal based on the created raster signal to the head driver 75 so that various ink droplets are discharged from the recording head 30 in line with the feeding of the paper P, the movement of the carriage 21 or the like. Then, the ink droplets are particularly discharged from the respective nozzles of the recording head 30 on the basis of the driving signal from the head driver 75.

In addition, the printing to the paper P includes an edge printing which does not form the image on the edges of the paper P (that is, ink droplets are not landed on the edges), and a non-edge printing which suitably forms the image even on the edges of the paper P (that is, ink droplets are landed on the edges). When the control command of the purpose of performing the non-edge printing is input from the main control portion 81, the image processing portion 82 creates raster data so that ink droplets can be discharged up to slightly to the right of the right end of the paper P and ink droplets can be discharged up to slightly to the left of the left end from the left end of the paper P.

The feeding control portion 83 outputs the control command to the ASF driver 74 in the case of feeding the paper P from the paper feeding cassette 17 into the printing portion 13. Then, the ASF motor 51 is driven based on the driving signal from the ASF driver 74, whereby the feeding roller 52 and the middle roller 55 are rotated. Furthermore, when the front end detection signal is input from the front end detection sensor 60, the feeding control portion 83 outputs the control command to the PF driver 73. Then, the PF motor 59 is driven on the basis of the driving signal from the PF driver 73, whereby the respective rollers of the paper feeding roller pair 57 and the paper discharging roller pair 58 are rotated, and the paper P is fed in the frame 18 from the rear side to the fore side. In addition, in the output shaft of the PF motor 59 of the present embodiment, a rotary encoder 89 for detecting the rotation speed, the rotation position and the rotation direction of the output shaft is provided. Moreover, the feeding control portion 83 controls the running of the PF motor 59 on the basis of the detection signal from the rotary encoder 89.

The CR control portion 84 calculates the position, the movement speed, and the movement direction in the left and right direction of the carriage 21 on the basis of the detection signal from the linear encoder 28, and controls the movement of the carriage 21 by outputting the control command based on the calculation result to the CR driver 72. Furthermore, when there is a request for the information (hereinafter, also referred to as "positional information") on the position of the carriage 21 from the paper information acquisition portion 85, the CR control portion 84 outputs the calculated positional information to the paper information acquisition portion 85. In addition, in the present embodiment, although the details will be described later, when the control command of the purpose of limiting the movement of the carriage 21 is input from the main control portion 81, the CR control portion 84 limits the movement scope of the carriage 21 depending on the control command.

The paper information acquisition portion 85 acquires the information on the paper P to be fed on the basis of various detection signals from the front end detection sensor 60 and the end portion detection sensor 31. Moreover, the paper information acquisition portion 85 suitably outputs the acquisition result to the feeding control portion 83 and the CR control portion 84, and stores the acquisition result in the memory 86 as the end portion positional information. Thus, in the present embodiment, an end portion detection unit detecting the end portion positional information on the position of the end portion in the width direction (the left and right direction) of the paper P is constituted by the linear encoder 28, the end portion detection sensor 31, the CR control portion 84, and the paper information acquisition portion 85. Furthermore, the memory 86 functions as the memory unit.

In addition, the end portion positional information includes the left and right end positional information including the information on the position of the right end and the position of the left end of the paper P to be printed, and left end portion positional information on the position of the left end of the paper P to be acquired for each pass. Moreover, at the time of the printing, on the basis of the initially acquired left and right end positional information, the positions of the left and right direction of the paper P on the platen 19 are detected, and the movement control of the carriage 21 or the discharging control of the ink droplets from the recording head 30 are performed based on the detection result. Furthermore, particularly, at the time of the non-edge printing, the respective end portions in the left and right direction of the paper P are detected based on the left end portion positional information to be acquired during printing, and the movement control of the carriage 21 or the discharging control of the ink droplets from the recording head 30 are performed based on the detection result.

Figure 7:
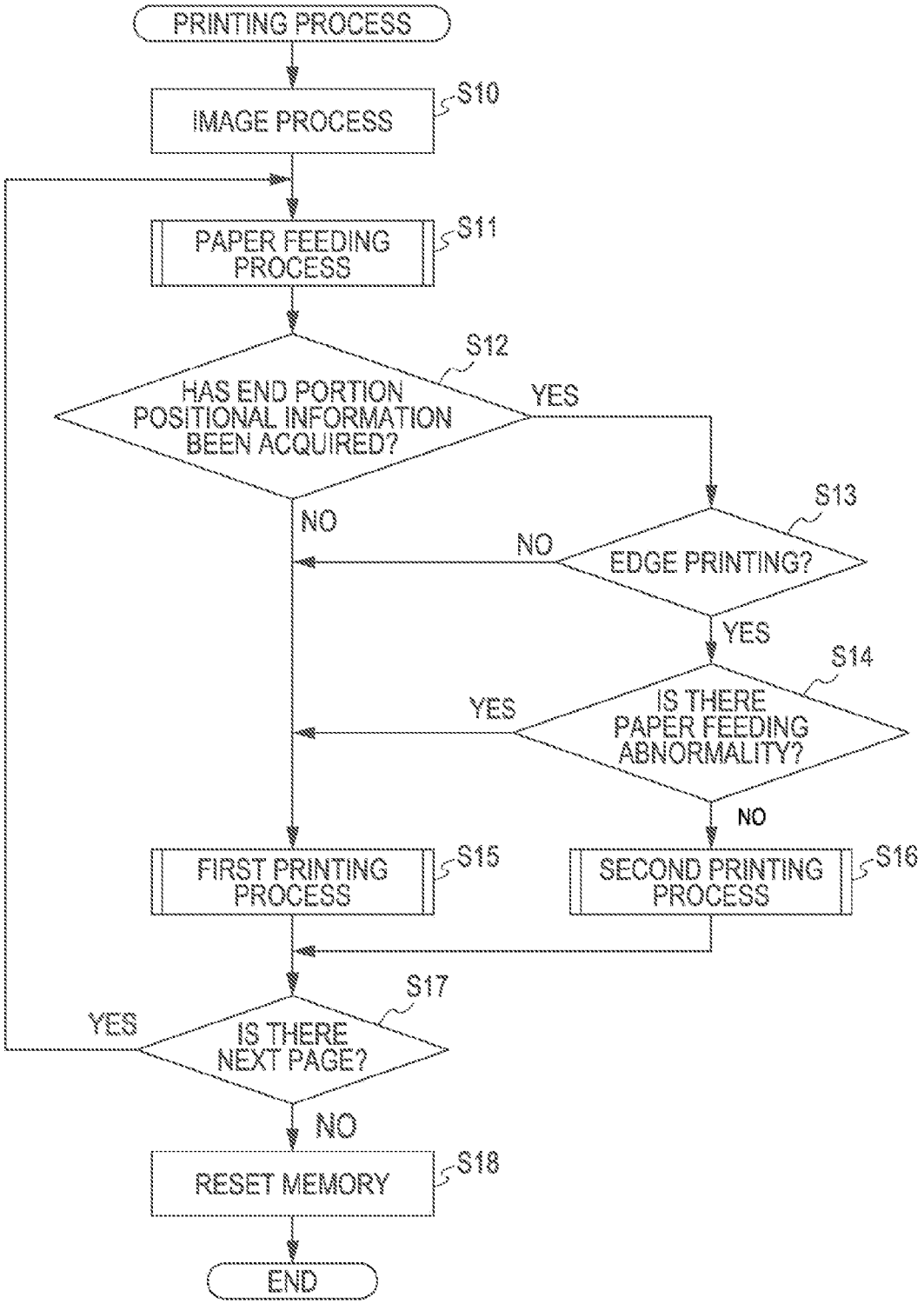
FIG. 7 is a flow chart that explains a printing processing routine of a first embodiment.
Figure 8A:
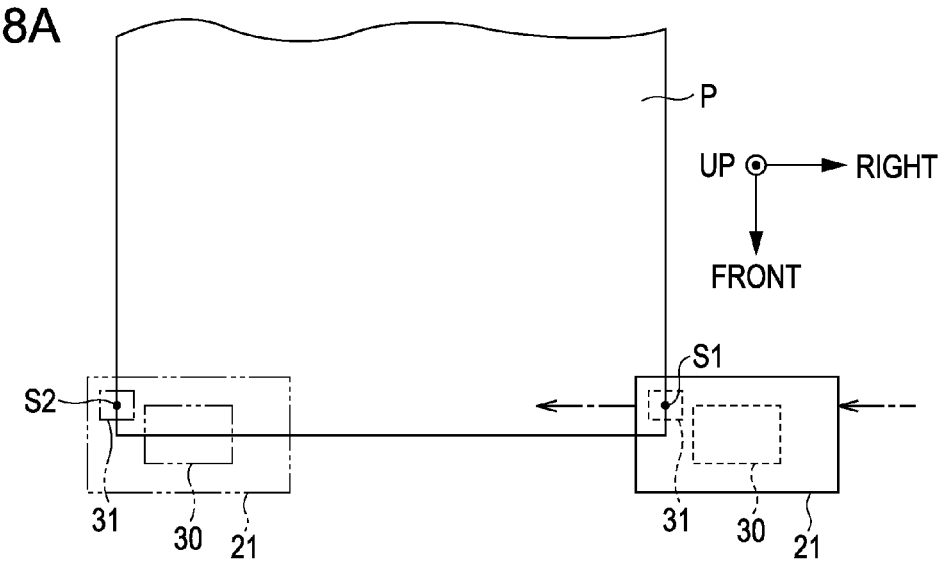
FIG. 8A is an operational diagram that explains a state in which a carriage is moved so as to enable left and right end positional information to be detected.

Next, a printing processing routine carried out by the control device 70 of the present embodiment will be described based on the flow chart shown in FIG. 7 and the operation diagrams shown in FIGS. 8A and 8B.

Incidentally, when the image information and the printing instruction is received from the host computer 87 (a receiving step), the main control portion 81 carries out the printing processing routine. Moreover, at initial step S10, the main control portion 81 outputs the control command of the purpose of carrying out the image processing of the image information to be kept in the reception buffer 80 to the image processing portion 82. Then, the image processing portion 82 performs various conversion processes of the image information to create the raster data.

In next step S11, the main control portion 81 outputs the control command of the purpose of carrying out the paper feeding process to the feeding control portion 83. Then, the feeding control portion 83 drives the ASF motor 51, and rotates the feeding roller 52 and the middle roller 55 so that the uppermost paper P in the paper feeding cassette 17 is fed into the frame 18. Moreover, when the front end detection signal is input from the front end detection sensor 60, in order to carry out head protruding process, the feeding control portion 83 drives the PF motor 59 and rotates the respective rollers of the paper feeding roller pair 57 and the paper discharging roller pair 58. At this time, the feeding control portion 83 controls the driving amount of the PF motor 59 based on the detection signal of the rotary encoder 89, that is, adjusts the position of the front end in the feeding direction of the paper P. Furthermore, the feeding control portion 83 stops the ASF motor 51 to stop the rotation of the feeding roller 52 and the middle roller 55 at the timing when the front end of the paper P is pinched between a pair of rollers constituting the paper feeding roller pair. Moreover, at the point in time when the head protruding process is completed, the feeding control portion 83 once stops the rotation of the PF motor 59, and outputs the purpose of the completion of the head protruding process to the main control portion 81.

In next step S12, the main control portion 81 determines whether or not the acquisition of the end portion positional information on the paper P (for example, the paper P1 of the first size) to be subjected to the current printing instructed by the printing instruction is completed. Moreover, when the end portion positional information on the paper P subjected to the current printing is not stored in the memory 86, since the acquisition is not completed, the main control portion 81 shifts the process to step S15 described later. Meanwhile, when the end portion positional information on the paper P subjected to the current printing is stored in the memory 86, since the acquisition is completed, the main control portion 81 shifts the process to next step S13.

In step S13, the main control portion 81 determines whether or not the current printing instructed by the printing instruction is the edge printing. That is, when the current printing is the non-edge printing, the main control portion 81 shifts the process to step S15 described later, and meanwhile, when the current printing is the edge printing, the main control portion 81 shifts the process to next step S14.

In step S14, the main control portion 18 determines whether or not the paper feed abnormality occurs at the time of the printing up to the prior page, based on the end portion positional information stored in the memory 86. Herein, the paper feed abnormality is a concept including a phenomenon in which the paper P fed onto the platen 19 is obliquely tilted (that is, skewed) with respect to the feeding position, or the position of the paper P on the platen 19 deviates from a predetermined position. Moreover, when the paper feed abnormality does not occur, the main control portion 81 shifts the process to step S16 described later, and meanwhile, when the paper feed abnormality occurs, the main control portion 81 shifts the process to nest step S15. Thus, in the present embodiment, the main control portion 81 also functions as a feed abnormality determination unit.

Herein, a detection method of a case where the paper P is skewed will be described. When the paper P to be fed is skewed, the position of the left end of the paper P to be detected for each pass is gradually displaced to one direction (the left or the right). When this state is detected based on the end portion positional information stored in the memory 86, it is determined that the skew occurs.

In step S15, the main control portion 81 outputs the control command of the purpose of carrying out the first printing process to the image processing portion 82, the feeding control portion 83 and the CR control portion 84. Then, as shown in FIG. 8A, the CR control portion 84 moves the carriage 21 from the home position side to the left. At this time, when the carriage 21 reaches the right end side position (the position shown by a solid line in FIG. 8A) corresponding to the right end side of the protruded paper P, the size of the detection signal from the end portion detection sensor 31 is changed. When the paper information acquisition portion 85 detects a change in size of the detection signal from the end portion detection sensor 31, the paper information acquisition portion 85 acquires the position in the left and right direction of the carriage 21 from the CR control portion 84 as the right end S1 of the paper P. Furthermore, when the carriage 21 is moved from the right end side position to the left and reaches the left end side position (a position shown by alternating long and two short dash lines in FIG. 8A) corresponding to the left end side of the paper P, the size of the detection signal from the end portion detection sensor 31 is changed again. When the paper information acquisition portion 85 detects a change in size of the detection signal from the end portion detection sensor 31, the paper information acquisition portion 85 acquires the position in the left and right direction of the carriage 21 from the CR control portion 84 as a left end S2 of the paper P. Moreover, the paper information acquisition portion 85 stores the left and right end positional information on the right end S1 and the left end S2 of the paper P, which was acquired upon moving the carriage 21 from the right end side position to the left end side position (or from the left end side position to the right end side position), in the memory 86. Thus, in the present embodiment, the step S15 corresponds to the positional information detection step.

Thereafter, the feeding control portion 83 controls the PF motor 59 so that the paper P can be intermittently fed to the front side at the timing when the carriage 21 is stopped or the timing immediately before the stop. Furthermore, the CR control portion 84 starts to move the carriage 21 at the timing when the PF motor 59 is stopped or the timing immediately the stop, and the image processing unit 82 discharges the ink droplets from the respective nozzles of the recording head 30 in synchronous with the movement of the carriage 21.

Figure 8B:
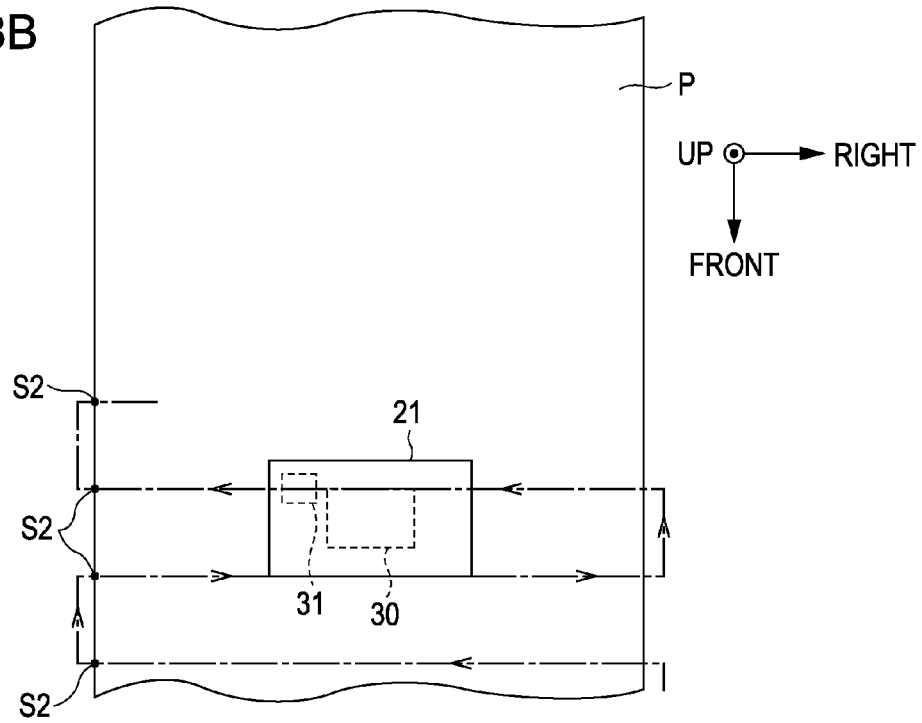
FIG. 8B is an operational diagram that explains a state in which a carriage is moved so as to enable left end portion positional information to be detected.

At this time, as shown in FIG. 8B, in the case of the pass in which the carriage 21 is moved from the right side to the left side, the CR control portion 84 necessarily moves the carriage 21 up to the left end side position. Then, the paper information acquisition portion 85 acquires the position of the left end S2 of the paper P from the CR control portion 84, based on the change in size of the detection signal from the end portion detection sensor 31. Moreover, the paper information acquisition portion 85 stores the left end portion positional information on the left end S2 of the acquired paper P in the memory 86. That is, in the first printing process, the left end portion positional information of the paper P is acquired for each pass. Moreover, when the printing (that is, the discharging of the ink droplets) of a sheet of paper P is completed, the main control portion 81 shifts the process to step S17 described later.

Meanwhile, in step S16, the main control portion 81 outputs the control command of the purpose of carrying out the second printing process to the image processing portion 82, the feeding control portion 83, and the CR control portion 84. Then, unlike the case of the first printing process, the CR control portion 84 does not move the carriage 21 so as to acquire the left and right end positional information. That is, the image processing portion 82, the feeding control portion 83 and the CR control portion 84 control the recording head 30, the PF motor 59 and the CR motor 24 so that the image can be immediately printed on the protruded paper P.

At this time, the CR control portion 84 does not move the carriage 21 up to the left end side position only so as to acquire the left end portion positional information of the paper P. Of course, when there is a need to discharge the ink droplets to the left end S2 of the paper P, the CR control portion 84 moves the carriage 21 up to the left end side position. That is, the second printing process is a printing process in which the left end portion positional information is not acquired, that is, the position of the left end of the paper P is not detected. Thus, in the present embodiment, the main control portion 81 selecting the first printing process or the second printing process also functions as the control unit. Furthermore, the step S16 corresponds to the control step. Moreover, when the printing (that is, the discharging of the ink droplets) of a sheet of paper P is completed, the main control portion 81 shifts the process to next step S17.

In step S17, the main control portion 81 determines whether or not the printing of the next page is performed by one printing instruction serving as the practice of the printing processing routine. Additionally, in the case of performing the printing of the next page, the main control portion 81 shifts the process to the step S11, and meanwhile, in the case of not performing the printing of the next page, the main control portion 81 shifts the process to next step S18. In addition, the sizes of the respective papers P in the case where a plurality of papers P is printed by one printing command are identical to each other.

In step S18, since the printing based on one printing command is entirely completed, the main control portion 81 resets (erases) the end portion positional information stored in the memory 86. Thereafter, the main control portion 81 finishes the printing process routine.

Figure 9:
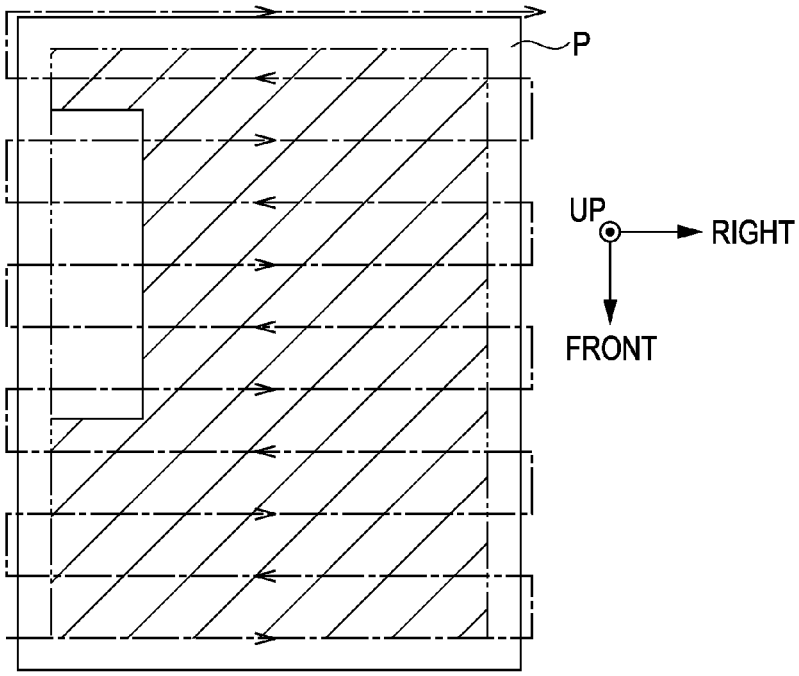
FIG. 9 is an operational diagram that explains a relative movement of the carriage relative to a paper at the time of a first printing process.
Figure 10:
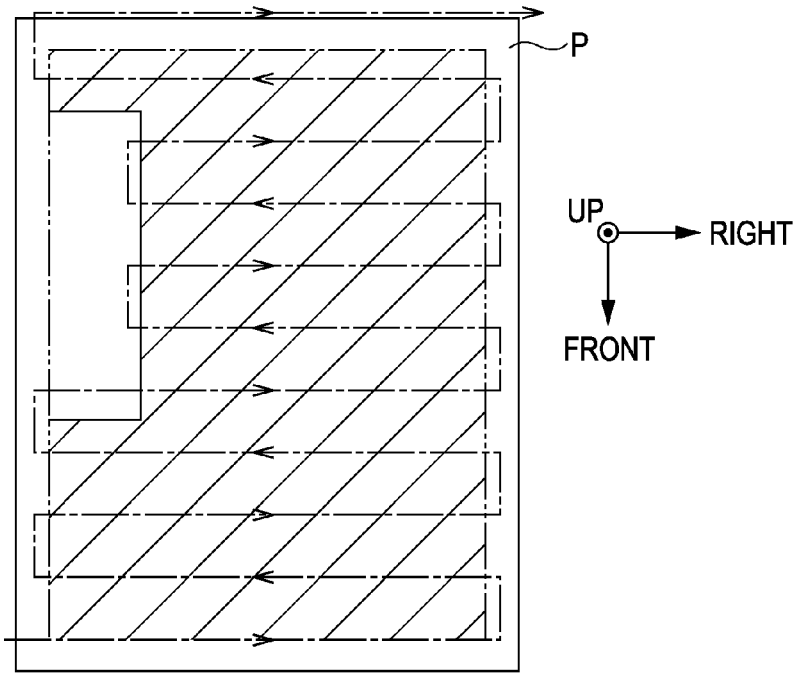
FIG. 10 is an operational diagram that explains a relative movement of the carriage relative to a paper at the time of a second printing process.

Next, an operation at the time of the printing of the printer 11 of the present embodiment will be described based on FIGS. 9 and 10. In addition, in FIGS. 9 and 10, a region surrounded by the alternate long and two short dash lines is a printing region at the time of the edge printing. Furthermore, in FIGS. 9 and 10, the ink droplets are attached to a hatched portion in the paper P, and meanwhile, the ink droplets are not attached to other portions. In addition, in FIGS. 9 and 10, the description of the carriage 21 is omitted, and the relative movement path of the carriage 21 based on the paper P is denoted by the alternate long and short dash line.

Incidentally, when the image information and the printing command are received from the host computer 87, the first paper P is supported on the platen 19. Then, the carriage 21 is moved from the right end side position to the left end side position just above the front end of the paper P immediately after being protruded (see FIG. 8A). At this time, the position of the right end S1 of the paper P and the position of the left end S2 of the paper P are acquired by the end portion detection sensor 31 and the linear encoder 28 mounted on the carriage 21. In addition, the length in the width direction (the left and right direction) of the paper P may be acquired. Moreover, the acquired left and right end positional information is stored in the memory 86.

Thereafter, the printing to the paper P is started. Then, the paper P is intermittently fed to the front side by the intermittent driving of the PF motor 59. Moreover, the carriage 21 is moved in the left and right direction at the timing when the feeding to the front of the paper P is stopped (or the timing immediately before the stop). Additionally, the ink droplets are individually discharged from the respective nozzles of the recording head 30 at the timing when the carriage 21 is situated on the printing region of the paper P. At this time, since the current paper P is the first page, in the case of the pass in which the carriage 21 is moved from the right side to the left side, the carriage 21 is moved to the left end side position of the paper P or to the left side from the left end side position even when the ink droplets are not discharged to the left end side of the paper P. Moreover, the position of the left end S2 of the paper P is acquired by the end portion detection sensor 31 and the linear encoder 28, and the acquired left end side positional information is suitably stored in the memory 86.

Furthermore, in the case of the pass in which the carriage 21 is moved from the left side to the right side, immediately after the movement to the right side of the carriage 21 starts, the position of the left end S2 of the paper P is acquired by the end portion detection sensor 31 and the linear encoder 28. Moreover, the acquired left end side positional information is suitably stored in the memory 86.

When the printing of the paper P of the first page is completed, the paper P of the first page is discharged to the outside of the frame 18, and the paper P of the second page is fed into the frame 18. Then, since the end portion positional information is stored in the memory 86 and there is an edge printing, the second printing process is carried out.

That is, with respect to the protruded paper P, the carriage 21 starts to move so that the ink droplets can be discharged from the recording head 30. At this time, since the carriage 21 does not acquire the left end portion positional information in the case of moving from the right end side to the left end side, the carriage 21 is moved only up to the position corresponding to the left end of the printing region. In addition, in a case where the carriage 21 may not be moved to the left end of the printing region so as to discharge the ink droplets in the pass in which the carriage 21 is moved from the right end side to the left end side, the carriage 21 is not moved to the left end of the printing region. That is, in the second printing process, the movement amount of the carriage 21 in the printing of one page is smaller than the case of the first printing process. The printing time of one page is shortened accordingly.

Additionally, when the printing of the paper P of the second page is completed, the paper P of the second page is discharged to the outside of the frame 18, and the paper P of the third page is fed into the frame 18. Then, similarly to the case of the paper P of the second page, the second printing process of the paper P of the third page is carried out.

Accordingly, according to the above-mentioned embodiment, the following effects can be obtained:

(1) In a case where the end portion positional information is stored in the memory 86, when the edge printing is performed with respect to the paper P having the same size of that of the paper P when the end portion positional information is stored, the carriage 21 is not moved up to the right end S1 or the left end S2 of the paper P so as to detect the end portion positional information. For that reason, it is possible to reduce the movement amount of the carriage 21 at the time of the printing to a sheet of paper P, as compared to a case where the carriage 21 is moved up to the right end S1 or the left end S2 of the paper P so as to detect the end portion positional information. Thus, it is possible to improve the printing speed (the recording speed) of the paper P as much as the movement amount of the carriage 21 can be reduced.

(2) Meanwhile, in a case where the non-edge printing of the paper P is performed, even in the printing of the paper P having the same size as that of the paper P when the end portion positional information is stored, the carriage 21 is moved up to the right end S1 or the left end S2 of the paper P so as to acquire the end portion positional information. Moreover, based on the frequently acquired left end portion positional information, the discharging control of the ink droplets from the recording head 30 in the vicinity of the right end S1 or the left end S2 of the paper P is performed. For that reason, unlike the case of performing the second printing process at the time of the non-edge printing, it is possible to maintain the printing accuracy to the paper P at the time of the non-edge printing.

(3) The feeding roller 52 is disposed in the center of the width direction of the paper P (P1, P2 and P3) to be accommodated in the paper feeding cassette 17. For that reason, it is possible to suppress the skew of the paper P as compared to a case where the feeding roller is disposed in a position corresponding to the end portion (for example, the right end portion) in the width direction of the paper P (P1, P2 and P3). Thus, it is possible to suppress a decline in printing accuracy of the paper P even in the case of performing the second printing process.

(4) Furthermore, there is a little possibility to be determined as the paper feed abnormality, and the probability that the second printing process is carried out is improved accordingly. Thus, it is possible to contribute to an improvement in printing speed.

(5) In a case where the edge printing of the image is performed in the plurality of papers P by one printing instruction, the first printing process is performed in the paper P of the first page is performed. The second printing process is performed in the papers P after the second page. That is, in the papers P after the second page, the image is printed based on the end portion positional information stored in the memory 86. Thus, it is possible to improve the printing speed of the papers P after the second sheets.

(6) Meanwhile, when the printing process based on one printing instruction is finished, the end portion positional information stored in the memory 86 is reset. For that reason, in a case where the printing instruction having different conditions (for example, the paper size, the edge printing or the non-edge printing) is received, it is possible to suppress the printing based on another printing instruction from being performed, on the basis of the end portion positional information acquired at the time of the printing process based on the prior printing instruction. Thus, it is possible to suppress the decline in printing accuracy of the paper P.

(7) When the feed abnormality (the skew of the paper P) occurs at the time of the printing to the paper P of the first page due to the current printing instruction, the first printing process is also performed in the papers P after the second page. Thus, it is possible to suppress the decline in printing accuracy based on the occurrence of the feed abnormality.

Second Embodiment

Figure 11:
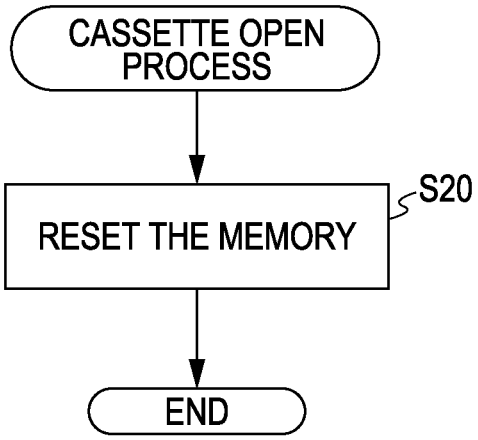
FIG. 11 is a flow chart that explains a cassette open processing routine of a second embodiment.

Next, a second embodiment of the invention will be described with reference to FIG. 11. In addition, the second embodiment is different from the first embodiment in the timing when the end portion positional information stored in the memory 86 is reset. Thus, in the following description, the portions different from the first embodiment will be mainly described, the components identical or equivalent to the first embodiment will be denoted by the same reference numerals and the overlapped description will be omitted.

A printing control routine of the present embodiment will be described.

Incidentally, in the printing processing routine, when the decision result of the step S17 is an affirmation decision, the main control portion 81 determines that the next page does not exist and finishes the printing processing routine. That is, in the printing processing routine performed whenever receiving the printing command, the end portion positional information stored in the memory 86 is not reset.

Next, a cassette open routine process, which is carried out when the detection signal to be input from the insertion and extraction sensor 48 is changed from the on signal to the off signal, will be described based on the flow chart shown in FIG. 11.

Incidentally, in the cassette open processing routine, the main control portion 81 resets (erases) the end portion positional information which includes a plurality of left end portion information and right end portion information stored in the memory 86 (step S20). Thus, in the present embodiment, the main control portion 81 also functions as the reset unit. Thereafter, the main control portion 81 finishes the cassette open processing routine.

That is, in the present embodiment, even if the printing process to the paper P based on one printing command is finished, the end portion positional information stored in the memory 86 is maintained. For that reason, in a case where another printing instruction is received by the reception buffer 80, when the edge printing is performed with respect to the paper P having the same size as the paper P (for example, the paper P2) when the end portion positional information is acquired, the second printing process is performed in the paper P of the first page. Of course, the second process is also in the paper P of the second page.

Thus, according to the present embodiment, in addition to the effects (1) to (4) and (7) in the first embodiment, the following effect can be obtained:

(8) In a case where the paper feeding cassette 17 is detached from the printer 11, there is a possibility that the paper feeding cassette 17 is remounted on the printer 11 in the state in which the paper P having the size different from that of before being detached is accommodated. Thus, in the present embodiment, at the time of the initial printing after the detached paper feeding cassette 17 is remounted on the printer 11, the first printing process is performed. For that reason, it is possible to store the suitable end portion positional information depending on the size of the paper P, which is accommodated in the paper feeding cassette 17 at this point of time, in the memory 86.

(9) Furthermore, in the present embodiment, when the paper feeding cassette 17 is detached from the printer 11, the end portion positional information stored in the memory 86 is reset. For that reason, when the paper feeding cassette 17 is remounted on the printer 11, it is possible to prevent the practice of the printing process using the end portion positional information acquired previously.

(10) Meanwhile, in a case where the edge printing is performed in the paper P having the same size as that of the paper P when the end portion positional information is stored in the memory 86, the second printing process is also performed in the paper P of the first page based on the printing command. Thus, the printing speed can be improved.

In addition, the respective embodiments may be changed as follows:

In the second embodiment, when the paper feeding cassette 17 is detached from the printer 11, the end portion positional information stored in the memory 86 may not be reset. In this case, when the paper feeding cassette 17 is remounted on the printer 11, the end portion positional information stored in the memory 86 may be reset.

Furthermore, when the size of the paper P accommodated in the paper feeding cassette 17 remounted on the printer 11 is identical to the size of the paper P accommodated in the paper feeding cassette 17 before being detached from the printer 11, the end portion positional information stored in the memory 86 may be used. Of course, when the size of the paper P accommodated in the paper feeding cassette 17 remounted on the printer 11 is different from the size of the paper P accommodated in the paper feeding cassette 17 before being detached from the printer 11, it is desirable to reset the end portion positional information stored in the memory 86 at the time of remounting the paper feeding cassette 17.

Furthermore, at the time of the initial printing when the paper feeding cassette 17 is remounted on the printer 11, the first printing process may be carried out regardless of whether or not the end portion positional information is stored in the memory 86. According to this configuration, the end portion positional information in the memory 86 is renewed to the newest end portion positional information.

In the respective embodiments, when the feeding roller 52 is disposed in the center of the left and right direction of the paper P in the paper feeding cassette 17, since there is very little possibility of the occurrence of the skew of the paper P, the decision process of step S14 may be omitted.

In the respective embodiments, the paper feeding cassette 17 may include a first accommodation portion which accommodates the paper P1 of the first size, and a second accommodation portion which accommodates the paper P2 of the second size. In this case, when the printing of the paper P1 is performed in a case where only the end portion positional information of the paper P2 is stored in the memory 86, the first printing process may be performed at the time of the printing to the paper P1 of the first page, and the end portion positional information of the paper P1 may be stored in the memory 86.

In the first embodiment, the printer 11 may be embodied to a printer that includes a paper feeding tray for manually setting the paper P. Even in the case, at the time of the printing based on one printing command, the first printing process may be performed in the printing of the first page, and the second printing process may be performed in the printing after the second page.

In the respective embodiments, when the printing mode is a high detail mode in which the printing accuracy takes precedence over the printing speed, the first printing process may be necessarily carried out. Meanwhile, at the time of the edge printing in the case of a high speed mode in which the printing speed takes precedence over the printing accuracy, the second printing process may be suitably carried out.

In the respective embodiments, the printer 11 may be a printer that can directly acquire the image information from the memory card without going through the host computer 87. In this case, when an operating portion (not shown) of the printer 11 is operated by a user, the printing instruction depending on the operation is temporarily maintained in the reception buffer 80 together with the image information. Similarly to the above-mentioned embodiments, the current printing instruction also includes the information on the size of the paper P, and the information on the edge printing and the non-edge printing or the like. Moreover, the second printing process may be suitably performed even at the time of the printing based on the image information that is directly acquired from the memory card.

Furthermore, the printer 11 may be a combiner having a scan function. Moreover, the second printing process may be suitably performed even at the time of the printing based on the image information acquired by the scan.

In the respective embodiments, although the recording device was embodied to an ink jet type serial printer, a liquid ejecting device may be adopted which ejects or discharges other liquid (a recording material) other than the ink, and the embodiments can be useful for various liquid ejecting devices that include a liquid ejecting head or the like for discharging a minute amount of liquid droplet. In addition, the liquid droplet refers to the state of liquid to be discharged from the liquid ejecting device and also include one that is extended in a particle shape, a tear shape, and a thread shape. Furthermore, the liquid may be a material that can be ejected by the liquid ejecting device. For example, the material may be one of the state in which the substance is a liquid shape, and includes a liquid state having a high or low viscosity, a flow state such as a sol water, a gel water, other inorganic solvent, an organic solvent a solution, a liquefied resin, and a liquefied metal (a metal solution), a liquid as a state of the substance, as well as a material in which a particle of a functional material formed of a solid matter such as a pigment or a metallic particle is melt, dispersed, and mixed in the solvent or the like. Furthermore, as a typical example of the liquid, the ink, a liquid crystal or the like as described in the embodiments may be adopted. Herein, the ink includes various ink compositions such a general water-based ink, an oil-based ink, a gel ink, and a hot melt ink. As a specific example of the liquid ejecting device, for example, a liquid ejecting device that ejects the liquid included so as to disperse and dissolve the material such as an electrode material or a color material used in the manufacturing of a liquid crystal display, an EL (electroluminescence) display, a surface emitting display, a color filter or the like, a liquid ejecting device that ejects a bio organic matter used in the manufacturing a bio chip, a liquid ejecting device that ejects liquid which is used as a precision pipette and becomes a specimen, a printing device, a micro dispenser or the like may be used. In addition, a liquid ejecting device that ejects a lubricant oil to precision machine by a pin point, a liquid ejecting device that ejects a transparent resin liquid such as an ultraviolet hardening resin so as to form a micro hemisphere lens (an optical lens) used in an optical communication element or the like, a liquid ejecting device that ejects an etching liquid such as acid or alkali so as to etch a substrate or the like may be adopted. Moreover, the aspect of the invention may be applied to a kind of the ejecting device among them.

In the respective embodiments, if the recording device is a device in which the recording unit is mounted on a moving member that moves in the scan direction intersecting the feeding direction of the recording medium, the recording device may be any recording device. For example, the recording device may be an impact type printer such as a dot impact type printer.

Next, the technical idea which can be understood from the respective embodiments and other embodiments will be additionally described as follows:

(A) A recording device which carries out the recording process with respect to a recording medium using a recording unit mounted on a moving member which reciprocates along a scan direction intersecting a feeding direction of the recording medium, including:

a reception unit that receives a recording instruction;

an accommodation device that is freely attached to and detached from the recording device and accommodates the recording medium before the recording process;

an end portion detection unit that detects a position of the end portion in the width direction of the recording medium, based on a detection signal from a signal output portion provided in the moving member;

a memory unit that stores end portion positional information on the position detected by the end portion detection unit; and a control unit that controls the movement of the moving member so that, in a case where the accommodation unit is not detached from the recording device between after the end portion positional information is stored in the memory unit and when the current recording instruction is received in the reception unit, when the start of the recording process to the recording medium is instructed by the recording instruction, the position of the end portion in the width direction of the recording medium is not detected.

(B) The recording device as set forth in technical idea (A), wherein, after the accommodation device is detached from the recording device, and the accommodation device is mounted on the recording device, and then, in the case of performing the recording process, the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium.

(C) A recording device which carries out the recording process with respect to a recording medium using a recording unit mounted on a moving member which reciprocates along a scan direction intersecting a feeding direction of the recording medium, including:

a reception unit that receives a recording instruction;

an end portion detection unit that detects a position of an end portion in the width direction of the recording medium, based on a detection signal from a signal output portion provided in the moving member;

a memory unit that stores end portion positional information on the position detected by the end portion detection unit;

a feed abnormality determination unit which determines whether or not the feed abnormality of the recording medium occurs, based on the end portion positional information stored in the memory unit at the time of the recording process to one recording medium; and a control unit that controls the movement of the moving member so that, in a case where it is determined that the feed abnormality does not occur by the feed abnormality determination unit, when the recording instruction is received by the reception unit, the position of the end portion in the width direction of the recording medium is not detected.

(D) The recording device as set forth in the technical idea (C), wherein, in a case where it is determined that the feed abnormality occurs by the feed abnormality determination unit, when current recording process is performed in which the recording instruction is received by the reception unit the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium.

(E) The recording device as set forth in any one of the technical ideas (A) and (B), further includes a reset unit that resets the end portion positional information stored in the memory unit when the separation of the accommodation device from the recording device is detected by the attachment and detachment detection unit, Wherein, when end portion positional information is not stored in the memory unit in a case where the reception unit receives a recording instruction, the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium, and stores the end portion positional information on the position in the memory unit.

What is claimed is:

1. A recording device which carries out a recording process with respect to a recording medium using a recording unit mounted on a moving member that reciprocates along a scan direction intersecting a feeding direction of the recording medium, comprising:

a reception unit that receives a recording instruction;

an end portion detection unit that detects a position of an end portion in a width direction of the recording medium, based on a detection signal which is output from a signal output portion provided in the moving member;

a memory unit that stores end portion positional information on the position detected by the end portion detection unit;

a control unit that controls the movement of the moving member so that, when end portion positional information from a prior recording medium is stored in the memory unit and an edge recording is instructed by the recording instruction, the position of the end portion in the width direction of the recording medium is not detected;

an accommodation device that can be freely attached to and detached from the recording device and accommodates the recording medium before the recording process; and an attachment and detachment detection unit that detects the detachment of the accommodation device from the recording device, wherein, after the detachment of the accommodation device from the recording device is detected by the attachment and detachment detection unit, the accommodation device is mounted on the recording device, and then, when the recording process is performed, the control unit allows the movement of the moving member to the end portion side in the width direction of the recording medium for detecting the position of the end portion in the width direction of the recording medium, and the end portion detection unit detects the position of the end portion in the width direction of the recording medium based on the detection signal from the signal output portion when the moving member is moved to the end portion side in the width direction of the recording medium, and stores the end portion positional information on the position in the memory unit.

2. The recording device according to claim 1, wherein, in a state in which the end portion positional information from a prior recording medium is stored in the memory unit, when a non-edge recording is instructed with respect to the next recording medium by the recording instruction, the control unit allows the movement of the moving member to the end portion side in the width direction of the next recording medium for detecting the position of the end portion in the width direction of the next recording medium, and the end portion detection unit detects the position of the end portion in the width direction of the next recording medium based on the detection signal which is output from the signal output portion when the moving member is moved to the end portion side in the width direction of the recording medium.

3. The recording device according to claim 1, further comprising:

a feeding device which can feed the recording media of a plurality of sizes having different lengths in the width direction and has a feeding roller coming into contact with a part in the width direction of the recording medium, wherein the feeding roller is disposed in a position where a first distance between the feeding roller and an end in the width direction of a recording medium having a first size is different from a first distance between the feeding roller and an end in the width direction of a recording medium having a second size different from the first size, and where a second distance between the feeding roller and the other end in the width direction of the recording medium having the first size is different from a second distance between the feeding roller and the other end in the width direction of the recording medium having the second size.

4. The recording device according to claim 1, wherein, in a case where the recording process to a plurality of recording media having the same sizes is performed by one recording instruction, at the time of the recording process to a first recording medium, the control unit allows the movement of the moving member to the end portion side in the width direction of the recording medium for detecting the position of the end portion in the width direction of the recording medium, the end portion detection unit detects the position of the end portion in the width direction of the recording medium based on the detection signal from the signal output portion when the moving member is moved to the end portion side in the width direction of the recording medium, and stores the end portion positional information on the position in the memory unit, and when the edge recording is carried out in the recording medium after a second recording medium, the control unit does not allow the movement of the moving member to the end portion side in the width direction of the recording medium for detecting the position of the end portion in the width direction of the recording medium.

5. The recording device according to claim 1, wherein, in a state in which the end portion positional information is stored in the memory unit, when the edge recording is instructed by the recording instruction, the control unit does not allow the movement of the moving member to the end portion side in the width direction of the recording medium for detecting the position of the end portion in the width direction of the recording medium.

6. A recording device which carries out a recording process with respect to a recording medium using a recording unit mounted on a moving member that reciprocates along a scan direction intersecting a feeding direction of the recording medium, comprising:

a reception unit that receives a recording instruction;

an end portion detection unit that detects a position of an end portion in a width direction of the recording medium, based on a detection signal which is output from a signal output portion provided in the moving member;

a memory unit that stores end portion positional information on the position detected by the end portion detection unit; and a control unit that controls the movement of the moving member so that, when end portion positional information from a prior recording medium is stored in the memory unit and an edge recording is instructed by the recording instruction, the position of the end portion in the width direction of the recording medium is not detected;

a feed abnormality determination unit which determines whether or not a feed abnormality of the recording medium occurs, based on the end portion positional information detected at the time of the recording process to one recording medium, wherein, in a case where it is determined that the feed abnormality occurs by the feed abnormality determination unit, when the recording process to a next recording medium is performed, the control unit allows the movement of the moving member to the end portion side in the width direction of the next recording medium for detecting the position of the end portion in the width direction of the next recording medium, and the end portion detection unit detects the position of the end portion in the width direction of the next recording medium based on the detection signal from the signal output portion when the moving member is moved to the end portion side in the width direction of the next recording medium.

7. A recording method of carrying out a recording process via a recording device with respect to a recording medium using a recording unit mounted on a moving member which reciprocates along a scan direction intersecting a feeding direction of the recording medium, the method comprising:

receiving a recording instruction;

detecting a position of an end portion in a width direction of the recording medium based on a detection signal that is output from a signal output portion provided in the moving member and storing end portion positional information on the position in a memory unit; and controlling the movement of the moving member so that, in a case where the end portion positional information from a prior recording medium is stored in the memory unit and the recording instruction instructs an edge recording, the end portion positional information is not detected;

detecting a detachment from the recording device of an accommodation device that can be freely attached to and detached from the recording device and accommodates the recording medium before the recording process;

in a case where the accommodation device is mounted on the recording device after the detachment of the accommodation device from the recording device is detected, controlling the movement of the moving member so that the movement of the moving member to the end portion side in the width direction of the recording medium for detecting the position of the end portion in the width direction of the recording medium is allowed, detecting the position of the end portion in the width direction of the recording medium based on the detection signal from the signal output portion when the moving member is moved to the end portion side in the width direction of the recording medium, and storing the end portion positional information on the position in the memory unit.

8. A recording method of carrying out a recording process with respect to a recording medium using a recording unit mounted on a moving member which reciprocates along a scan direction intersecting a feeding direction of the recording medium, the method comprising:

receiving a recording instruction;

detecting a position of an end portion in a width direction of the recording medium based on a detection signal that is output from a signal output portion provided in the moving member and storing end portion positional information on the position in a memory unit; and controlling the movement of the moving member so that, in a case where the end portion positional information from a prior recording medium is stored in the memory unit and the recording instruction instructs an edge recording, the end portion positional information is not detected, determining whether or not a feed abnormality of the recording medium occurs, based on the end portion positional information detected at the time of the recording process to one recording medium, in a case where it is determined that the feed abnormality occurs, when the recording process to the next recording medium is performed, controlling the movement of the moving member so that the movement of the moving member to the end portion side in the width direction of the next recording medium for detecting the position of the end portion in the width direction of the next recording medium is allowed, and detecting the position of the end portion in the width direction of the next recording medium based on the detection signal from the signal output portion when the moving member is moved to the end portion side in the width direction of the next recording medium.

* * * * *